US005871686A

United States Patent [19]

Nivoche

[11] Patent Number: 5,871,686

[45] Date of Patent: Feb. 16, 1999

[54] DEVICE FOR COOLING A ROLLED PRODUCT

[75] Inventor: Claude Nivoche, Elancourt, France

[73] Assignee: Selas S.A., Gennevilliers Cedex, France

[21] Appl. No.: 710,383

[22] Filed: Sep. 10, 1996

[30] Foreign Application Priority Data

Sep. 12, 1995 [FR] France ..... 95 10669

[51] Int. Cl.[6] ..... C21B 7/10

[52] U.S. Cl. ..... 266/46; 266/111

[58] Field of Search ..... 266/46, 103, 111

[56] References Cited

U.S. PATENT DOCUMENTS

| | | | |
|---|---|---|---|
| 3,262,688 | 7/1966 | Beggs | 266/111 |
| 4,704,167 | 11/1987 | Ichida et al. | 148/153 |
| 5,327,763 | 7/1994 | Kramer et al. | 72/257 |

FOREIGN PATENT DOCUMENTS

| | | | |
|---|---|---|---|
| 0145847 | 6/1985 | European Pat. Off. . | |
| 0182050 | 5/1986 | European Pat. Off. . | |
| 1337313 | 12/1963 | France . | |
| 57-171627 | 10/1982 | Japan . | |
| 57-188624 | 11/1982 | Japan . | |
| 0046291 | 11/1984 | Japan | 266/111 |
| 92/02316 | 2/1992 | WIPO . | |

*Primary Examiner*—Scott Kastler
*Attorney, Agent, or Firm*—Banner & Witcoff, Ltd.

[57] ABSTRACT

A device for cooling a rolled product such as a steel strip moving in front of the device includes a box filled with a pressurized gas. The box comprises a plurality of fins forming pipes, each fin including at least one gas outlet orifice directed towards at least one surface of the rolled product. The orifices of each fin are aligned in the transverse direction of the rolled product. Each space between two adjacent fins has a depth in a direction perpendicular to the surface of the rolled product and a width in the longitudinal direction of the rolled product sufficient to enable evacuation of the gas without disrupting the exit of the gas from the adjacent fins.

12 Claims, 3 Drawing Sheets

DEVICE FOR COOLING A ROLLED PRODUCT

BACKGROUND OF THE INVENTION

1. Field of the Invention

The present invention concerns a device for cooling a rolled ferrous or non-ferrous product, especially a steel strip.

2. Description of the Prior Art

Heat treatment of rolled products that pass vertically over rollers and through successive treatment chambers is known in itself. In the manufacture of steel plate for automobile bodies, continuous annealing or galvanization lines are used on which the steel is heated to temperatures of up to 600° C.–900° C. Rapid and uniform cooling of these products is then needed to reduce the temperature of the product to a temperature below 500° C. depending on the quality required.

Various cooling methods have been used before now. Passing the rolled product over cooled rollers or immersing it in a liquid or a semi-liquid medium is known in itself, for example. These two-phase conduction or convection cooling methods provide local thermal transfer coefficients in excess of 400 kCal/m$^2$·h·°C., but for small temperature drops. Moreover, these methods have the drawback of generating problems of oxidation of the rolled product and contact of the rolled product with the cooling liquid or solid frequently causes flatness defects.

Another type of method, by spraying a gas, avoids the previously mentioned drawbacks. U.S. Pat. No. 4,363,471 describes a steel annealing line in which the steel strip passes across the front of a box containing a series of gas blower nozzles. These nozzles project only slightly from the surface of the box, however. Evacuation of the gas after it impinges on the steel strip is impeded by the box: back-pressure areas then arise between the nozzles and the box, disrupting the blowing of the cooling gas towards the steel strip. Moreover, the gas can only escape laterally, across the width of the rolled product, which produces differential cooling of the edges of the rolled product and may lead to flatness defects. The thermal transfer coefficients achieved by this type of device do not exceed 200 kCal/m$^2$·h·°C. for a gas comprising a mixture of nitrogen and 5 hydrogen, and even lower for air.

In the article by T. Kaihara et al "New technology in KM-CAL for sheet gage" published in "Developments in annealing rolled steel", ed. Pradan and Gupta, 1992 it is indicated that a maximum rate of 50° C./s can be obtained for a rolled product with a thickness equal to 0.7 mm, which is equivalent to a transfer coefficient of around 175 kCal/m$^2$·h·°C.

An article by Hiroshi Takechi entitled "Recent developments in the Metallurgical Technology of Continuous Annealing for Cold-rolled and Surface-coated sheet steels" in the same publication discloses that, even if the gas outlet orifices are at a distance of 50 mm from the rolled product, it is not possible to obtain a cooling rate of better than 100° C./s for a plate less than 0.35 mm thick, corresponding to a transfer coefficient of 200 kCal/m$^2$·h·°C.

Document WO 92/02316 describes a cooling device in which an extrusion moves horizontally between fin-form pipes having gas outlet orifices in the transverse direction of the extrusion. Only the relative position of the top and bottom fins, in a staggered arrangement, is specified to obtain uniform cooling of the extrusion. In this document, however, there is no discussion of the problem of evacuating the gas after it impinges on the extrusion. The impingement of the gas on the extrusion is disrupted by the stagnant gases between the fins.

The article by IMOSE "Heating and cooling technology in continuous annealing" (ISIJ Transactions, Vol. 25, 1985, 911–932) indicates that a thermal transfer coefficient equal to 250 kCal/m$^2$·h·°C. at most can be obtained by increasing the speed and the volume of the gas, by reducing the distance between the rolled product and the blower nozzles and by enriching the gas with hydrogen. This value of the thermal transfer coefficient is nevertheless too low to significantly accelerate cooling of the rolled product.

Moreover, all of the methods that increase the hydrogen content in order to increase the transfer coefficient are difficult to render compatible with safety standards and represent real hazards to the operators.

The table below summarizes the various methods proposed before now for cooling a steel strip from 600° C. to 400° C.

| Cooling method | Heat transfer coefficient (kCal/m$^2$ · h · °C.) | Rate of cooling between 600° C. and 400° C. for a steel strip 1 mm thick (°C./s) | Remarks |
|---|---|---|---|
| Gas jets - | 100 | 17 | too low |
| normal | 250 | 42 | only for a high hydrogen content |
| extreme possible* (*IMOSE) | | | |
| Cooled rollers | 1000 | 160 | serious flatness defects |
| Immersion in hot water (≧90° C.) | 400 | 67 | Oxidation of product |
| Immersion in cold water | 6000 | 1000 | Oxidation of product and impossible to stop cooling |
| By mist spray | 600 | 100 | Oxidation of product |
| cold water | | | product and impossible to stop cooling |
| By mist spray | 600 | 100 | Oxidation of product |

The aim of the present invention is to propose a gas projection type cooling device that can cool a rolled product with a thermal transfer coefficient greater than 350 kCal/m$^2$·h·°C., using an innocuous gas.

SUMMARY OF THE INVENTION

The invention consists in a device for cooling a rolled product, such as a steel strip, moving in front of said device, comprising means for gaseous pressurization of at least one box, said box comprising a plurality of fins forming pipes, each fin including at least one gas outlet orifice directed towards at least one surface of the rolled product, the orifices of each fin being aligned in the transverse direction of the rolled product, wherein each space between two adjacent fins has a depth in a direction perpendicular to the surface of the rolled product and a width in the longitudinal direction of the rolled product sufficient to enable evacuation of the gas without disrupting the exit of the gas from the adjacent fins, the ratio of the flowrate of the gas in m$^3$/s at the outlet of the set of orifices of a fin to the cross-section in m$^2$ of the space between said fin and either of the adjacent fins being less than 20, said cross-section corresponding to a cross-section in a plane perpendicular to the rolled product and parallel to the direction of movement of said rolled product.

Because of the spaces provided between the series of orifices, evacuation of the blown gas is facilitated. Emission of the gas jets is therefore not impeded and the speed of the jets can be as high as 220 m/s.

By maintaining the gas flowrate below a threshold determined in accordance with the cross-section of the separation space, the circulation of the gas in the cooling device is regular and the gas can be evacuated without causing differential cooling of the edges. The cooling device of the invention is therefore perfectly suited to continuous heat treatment as used in continuous steel treatment lines.

In this way cooling rates that are much higher than those obtained with conventional gas blower type devices are obtained. Transfer coefficients in excess of 350 kCal/$m^2$·h·°C. are obtained.

In one advantageous version of the invention, the depth of each space is greater than 200 mm and preferably greater than 300 mm.

The return flow of the gas, after it impinges on the surface of the rolled product, is facilitated by this depth between the rear of the outlet orifices and the box. This avoids the accumulation of the gas at the level of the outlet orifices: in this way the blowing of the cooling gas is not disrupted by stagnant gas escaping with difficulty between the outlet orifices.

In one preferred version of the invention, the distance between the adjacent fins is between 0.8 and 5 times the distance between orifices of the same fin.

In this way the fins are sufficiently close together at the height of the gas outlet orifices to cool uniformly all of the surface of the rolled product moving past the outlet orifices.

In accordance with another aspect of the invention, a cooling installation includes at least one cooling device in which stabilizing rolls are provided on opposite sides of the cooling device(s), said rolls being adapted to deflect the rolled product by an angle less than 7°.

In this way it is possible to obtain a high cooling capacity, the rollers preventing the rolled product from vibrating due to the effect of the pressure of the blown cooling gas.

Other features and advantages of the invention will emerge from the following description.

In the accompanying drawings, given by way of non-limiting example:

DETAILED DESCRIPTION OF THE PREFERRED EMBODIMENT

The cooling device of the invention is designed to be integrated into a continuous annealing line as conventionally used for treatment of steel strip.

These steel strips are between 0.15 mm and 2.3 mm thick. Their width is in the order of 0.6 m to 2 m.

In heat treating steel strip it is necessary to cool the strips in a very short time from a temperature around 600° C.–900° C. to a temperature below 500° C.

In the case of cooling after coating or hot quenching of the steel by immersion in a bath of molten metal, it is important to cool the strip very quickly after it is hot dip coated, down to a temperature of around 200° C. to 300° C. This cooling is achieved with air.

Figure 1:
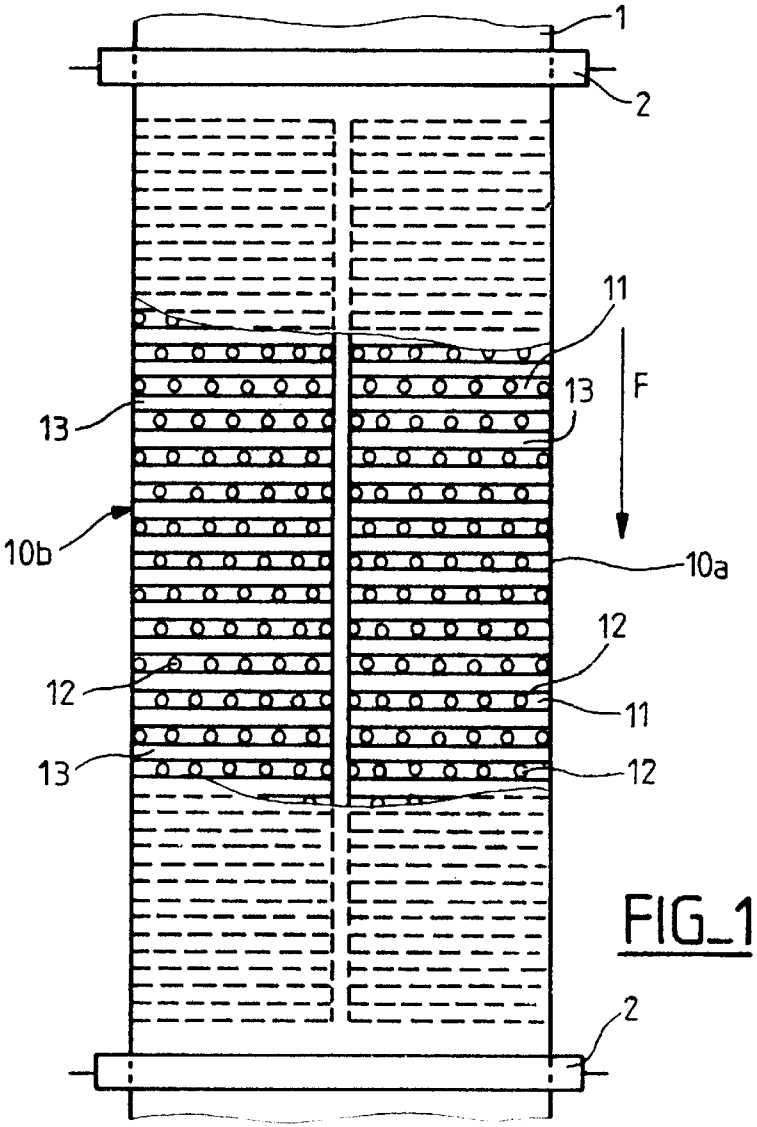
FIG. 1 is a front view of a cooling device of the invention.
Figure 2:
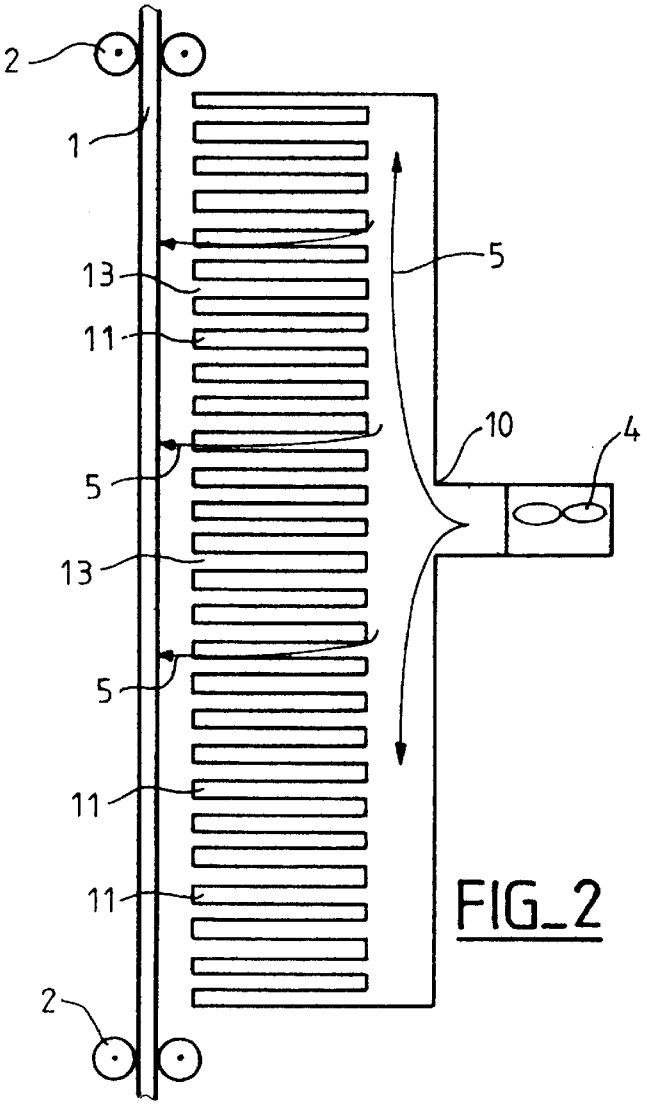
FIG. 2 is a side view of the device from FIG. 1.

Referring to FIGS. 1 and 2, the rolled product 1 passes vertically in the direction of the arrow F between conveyor rollers 2.

The cooling device comprises means 4 for pressurizing a box 1 with gas.

The box 1 extends parallel to the surface of the rolled product and is fed by at least one fan 4 adapted to introduce a high flow of pressurized cooling gas 5 into the box. Of course, a plurality of blower fans uniformly distributed over the height of the box could be used. The fan could equally well be replaced by a compressor.

For simplicity, only one box 10 is shown in FIG. 2, although the device of the invention preferably comprises a second box 10 disposed symmetrically to the rolled product so that the latter is cooled on both faces at the same time.

Figure 3:
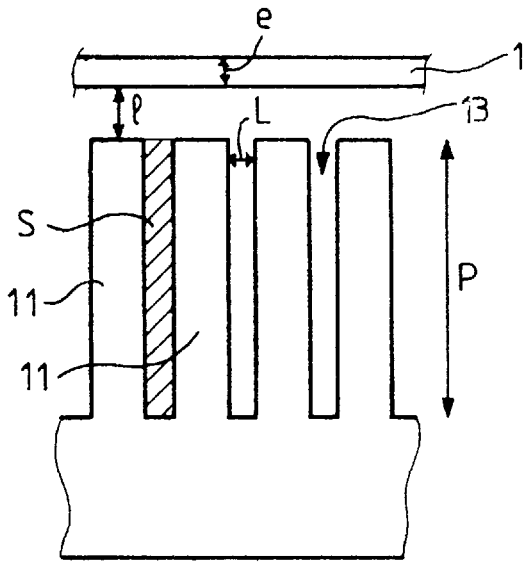
FIG. 3 is a diagram showing the disposition of the cooling device relative to a rolled product.
Figure 4:
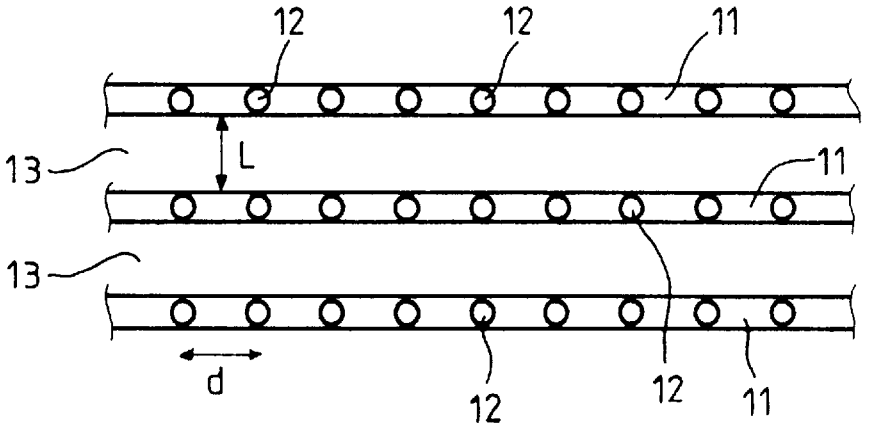
FIG. 4 is a diagram showing the respective disposition of the blower orifices.

The box contains a plurality of pipes in the form of fins 11, outlet orifices 12 for the gas 5 facing towards the surface of the rolled product 1 being provided at the end of the fins 11. The orifices 12 of each fin 11 are aligned with the transverse direction of the rolled product 1. As shown in FIGS. 3 and 4, each space 13 between two adjacent fins has a depth P in a direction perpendicular to the surface of the rolled product 1 and a width L in the longitudinal direction of the rolled product 1 that are sufficient to enable evacuation of the gas 5.

Each orifice 12 is at the end of a pipe formed by a fin 11 extending from the box 10 towards the rolled product.

The gas 5 can escape towards the rear after it impinges on the rolled product, between the fins. In the situation where, to avoid oxidizing the product, cooling must be carried out in a protective atmosphere, for example in a mixture of nitrogen and hydrogen, all of the cooling device is surrounded in a manner that is known in itself with a sealed jacket enabling the blown gas to be recovered for continuous recycling in the gas pressurization means. Recycling includes a gas recovery step, a gas cooling step and a re-injection step.

The temperature of the gas in the box is below 100° C.

The distance D between adjacent fins 11 is between 0.8 and 5 times the distance d between the orifices 12 of the same fin 11. This distance D corresponds to the distance between the fins 11 in the flow direction F at the height of the orifices 12.

The distance d between the orifices 12 of the same series is uniform.

The distance D between two adjacent fins is preferably between 30 mm and 200 mm.

Moreover, as shown in FIG. 4, the orifices can be aligned in the longitudinal direction of the rolled product so that they form the four corners of contiguous squares.

The orifices can instead be staggered as shown in FIG. 1 so that they form the corners of contiguous lozenges.

The distribution of the cooling gas jets is therefore uniform over all of the surface of the rolled product.

The orifices are circular, rectangular, oblong, etc holes or small slots. Each fin can have a single outlet orifice forming a slot facing the rolled product.

For correct operation of the device and rapid cooling of the rolled product it is important for the depth of each separation space 13 to be greater than 200 mm and preferably greater than 300 mm.

The ratio of the flowrate of the gas 5 in $m^3/s$ at the outlet of all of the orifices 12 of a fin 11 to the cross-section S in $m^2$ of the space 13 between that fin 11 and the adjacent fins is less than 20. The cross-section S corresponds to the cross-section in a plane perpendicular to the rolled product and parallel to the direction of movement of that product.

The speed of the gas when it escapes towards the exhaust or towards the pump suction inlet (depending on whether the gas is recycled or not) in the spaces 13 between the fins 11 is therefore maintained below a critical value of 20 m/s to limit turbulence in these spaces 13 that would disturb the evacuation of gas after it impinges on the rolled product.

The equivalent diameter of the orifices 12 can be between 5 mm and 15 mm: the equivalent diameter corresponds to the diameter of a circle having the same cross-section area as the orifice.

Given the above, it is advantageous to dispose the cooling device so that the outlet orifices 12 are at a distance l from the surface of the rolled product 1 between 5 and 12 times the equivalent diameter of the orifices 12, preferably between 6 and 8 times the equivalent diameter.

To be able to modify the distance l it is advantageous for the boxes 10 to be mobile in a direction perpendicular to the rolled product 1, so that they can be moved closer to or further away from the rolled product.

Figure 5:
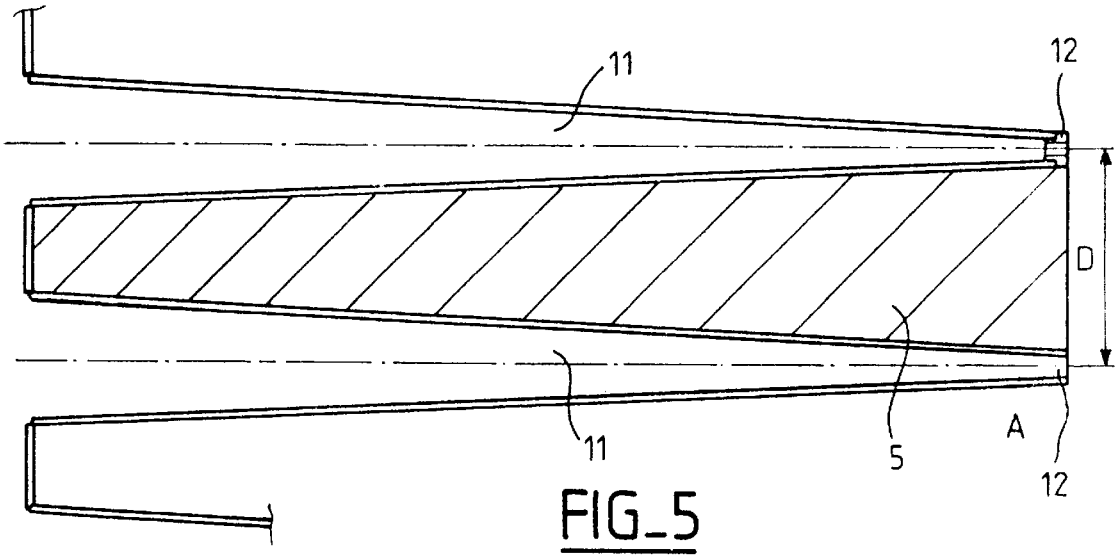
FIG. 5 is a diagrammatic view of the fins of the cooling device of the invention.

As shown in FIG. 5, each fin forming a pipe 11 preferably has a cross-section that decreases in the direction of flow of the gas, i.e. from the box to the outlet orifice 12. The height of the interior conduit in the fin 11 decreases continuously in the vertical direction F in which the rolled product 1 moves.

The outlet orifice 12 has a profile such that its cross-section is substantially the same as the outlet cross-section of the fin 11. This construction produces a high gas speed at the outlet with limited unwanted head losses.

The fins and the orifices can be manufactured by molding, forming, pressing, assembling and/or machining.

Figure 6:
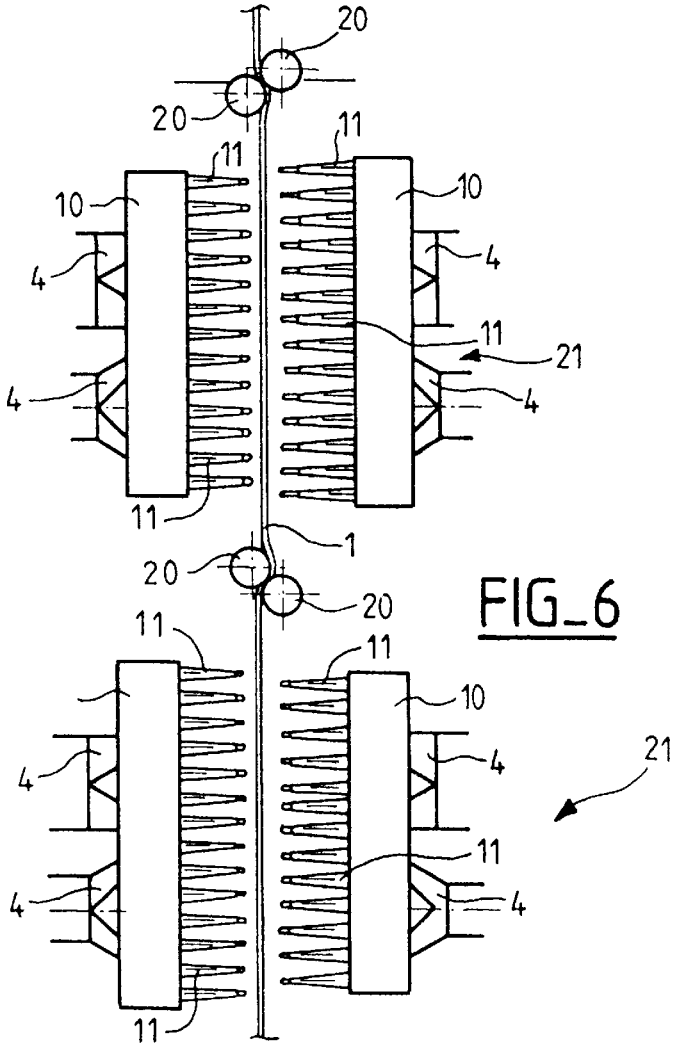
FIG. 6 is a view of a cooling installation in accordance with the invention.

Referring to FIG. 6, a cooling installation of the invention includes at least one cooling device 21. Stabilizing rolls 20 are provided on opposite sides of the cooling device(s) 21, the rollers being adapted to deflect the rolled product 1 not more than 7°.

These rolls limit vibration of the product, especially if the distance l between the orifices 12 and the product is small. The rolls are mobile laterally, i.e. perpendicularly to the rolled product, to align the latter, and are motor driven to drive the moving product.

The heightwise distance between two series of rolls 20 is less than or equal to 6 m and the height of a stack of pipes in the same device 21 is less than or equal to 5 m. This minimizes vibration of the product whilst procuring a very high cooling capacity.

The cooling device preferably comprises a number of flat fins in the longitudinal direction of the rolled product, each fin including a number of orifices 12 such that the total cross-section of the orifices of the device is between 1% and 5% of the surface area covered by the set of fins, preferably between 2% and 4% of that surface area.

The cooling device comprises at least one box 10 on each side of the rolled product. It preferably comprises a plurality of boxes 10*a*, 10*b* on the same side of the rolled product 1. In this way between one and seven boxes are positioned side by side across the width of the rolled product, with the pressure regulated independently to achieve transversely homogeneous cooling. The intensity of cooling could be varied across the width of the rolled product in accordance with a desired thermal profile.

The gas used in a mixture of hydrogen and nitrogen, the amount of hydrogen preferably being less than or equal to 5%. The gas may equally well be air or pure nitrogen.

By means of the cooling device of the invention, a 0.8 mm thick steel strip can be cooled at a rate exceeding 80° C./s, i.e. corresponding to a transfer coefficient at least equal to 400 $kCal/m^2 \cdot h \cdot °C$.

Of course, the invention is not limited to the embodiment described hereinabove and many modifications may be made thereto without departing from the scope of the invention.

There is claimed:

1. A method for cooling a flat rolled product moving in front of a device comprising at least one box comprising a plurality of fins forming pipes, each fin including at least one gas outlet orifice directed towards at least one surface of said rolled product, said orifices of each fin being aligned in the transverse diction of said rolled product, comprising the step of introducing a flow of pressurized cooling gas in said box and maintaining said flow such that the ratio of the flowrate of said gas in $m^3/s$ at the outlet of the set of orifices of a fin to the cross-section in $m^2$ of the space between said fin and either of the adjacent fins is less than 20 to enable evacuation of said gas without disrupting the exit of said gas from the adjacent fins, said cross-section corresponding to a cross section in a plane perpendicular to said rolled product and parallel to the direction of movement of said rolled product.

2. The method claimed in claim 1 wherein the depth of each space is greater than 200 mm.

3. The method claimed in claim 1 wherein the distance between adjacent fins is between 0.8 and 5 times the distance between the orifices of the same fin.

4. The method claimed in claim 1 wherein the distance between adjacent fins is between 30 mm and 200 mm.

5. The method claimed in claim 1 wherein the distance between orifices of the same fin is uniform.

6. The method claimed in claim 1 wherein the cross-section of said fin decreases in the direction from said box to said orifices.

7. The method claimed in claim 1 wherein the device comprises a plurality of boxes disposed on the same side of said rolled product and positioned side by side across the width of said rolled product, the pressure in each box being regulated independently.

8. The method claimed in claim 1 wherein the distance between said orifices and the surface of said rolled product is between 5 and 12 times the equivalent diameter of said orifices.

9. The method claimed in claim 1 wherein said gas is a mixture of hydrogen and nitrogen, said deice being surrounded by a sealed enclosure and said gas being recycled continuously.

10. The method claimed in claim 1 wherein said fins and said orifices are molded, formed, pressed, assembled, or combinations thereof.

11. The method claimed in claim 1 further comprising determining a maximum value for the flow rate of a said pressurized cooling gas in accordance with a heat transfer coefficient and maintaining said flow below said maximum.

12. The method as claimed in claim 11 further comprising determining a maximum value for the flow rate of said pressurized cooling gas to obtain a heat transfer coefficient higher than 350 $kCal/M^2 \cdot h \cdot °C$.

* * * * *